US011317728B2

(12) United States Patent
Rogers

(10) Patent No.: US 11,317,728 B2
(45) Date of Patent: May 3, 2022

(54) KNEE PILLOW AND METHOD OF USE

(71) Applicant: Beth Rogers, Scottsdale, AZ (US)

(72) Inventor: Beth Rogers, Scottsdale, AZ (US)

( * ) Notice: Subject to any disclaimer, the term of this patent is extended or adjusted under 35 U.S.C. 154(b) by 219 days.

(21) Appl. No.: 16/745,039

(22) Filed: Jan. 16, 2020

(65) Prior Publication Data

US 2020/0221880 A1 Jul. 16, 2020

Related U.S. Application Data

(60) Provisional application No. 62/792,992, filed on Jan. 16, 2019.

(51) Int. Cl.
*A47C 20/00* (2006.01)
*A47G 9/10* (2006.01)

(52) U.S. Cl.
CPC ..... *A47C 20/021* (2013.01); *A47G 9/10* (2013.01); *A47G 2009/1018* (2013.01)

(58) Field of Classification Search
CPC ..... A47C 20/021; A47G 9/10
See application file for complete search history.

(56) References Cited

U.S. PATENT DOCUMENTS 830,661 A * 9/1906 Gresham ..... A41D 13/065 2/24
967,004 A * 8/1910 Ehikian ..... A41D 13/065 2/24
2,093,888 A * 9/1937 Holtje ..... A41D 13/065 2/24
2,195,817 A * 4/1940 Johnson ..... A47L 13/62 2/24
2,366,680 A * 1/1945 Valentine ..... A47C 7/021 217/3 R
2,552,476 A * 5/1951 Barton ..... A47C 7/029 5/951
2,805,420 A * 9/1957 Spellos ..... A41D 13/065 2/24
3,141,179 A * 7/1964 McLean ..... A47C 21/003 5/636
3,848,281 A * 11/1974 Mathews ..... A47G 9/10 5/636
3,902,456 A * 9/1975 David ..... A01K 1/0353 D6/601

(Continued)

FOREIGN PATENT DOCUMENTS

KR 200437454 Y1 * 12/2007

*Primary Examiner* — Eric J Kurilla
(74) *Attorney, Agent, or Firm* — Schmeiser, Olsen & Watts, LLP

(57) ABSTRACT

Disclosed is a pillow for placing between the knees while sleeping. The pillow has a substantially toroid-shaped outer casing with an inner volume containing a fill material. The generally uniform round shape of embodiments of the pillow provides for easy insertion of the pillow between the knees because the pillow does not have to be oriented in any particular radial direction prior to insertion. Some embodiments of the pillow may have a hole through the center. Both the top and bottom surfaces of embodiments of the pillow curve downward and inward toward the center, forming a top and bottom depression for cradling the knee joints while preventing the pillow from unintentionally sliding out from between the knees. A method of using a pillow for placing between the knees is also disclosed.

11 Claims, 8 Drawing Sheets

(56) References Cited

U.S. PATENT DOCUMENTS

D239,395 S * 3/1976 David ..... D30/118
4,563,785 A * 1/1986 Samelson ..... A47G 9/10 112/475.08
5,557,815 A * 9/1996 Mintz ..... A47C 27/00 297/283.1
5,634,223 A * 6/1997 Obermaier ..... A47C 9/002 297/452.41
D386,348 S * 11/1997 Weidman ..... D6/601
D412,082 S * 7/1999 Goodrich ..... D6/601
6,052,850 A * 4/2000 Salido ..... A47G 9/10 5/655
D429,592 S * 8/2000 Dohan ..... D6/601
6,266,832 B1 * 7/2001 Ezell ..... B60N 2/2881 5/636
D486,757 S * 2/2004 Peterson ..... D12/11
6,745,418 B1 * 6/2004 Turner, Jr. ..... A47G 9/1027 D6/601
6,857,150 B2 * 2/2005 Matthews Brown .... A47D 5/00 5/655
6,859,964 B1 * 3/2005 Arnott ..... A47G 9/10 5/636
7,066,950 B2 * 6/2006 Jung, Jr. ..... A61F 7/02 607/114
D638,647 S * 5/2011 Heroux ..... D6/601
D639,100 S * 6/2011 Heroux ..... D6/601
D645,686 S * 9/2011 Heroux ..... D6/601
D645,687 S * 9/2011 Heroux ..... D6/601
D645,688 S * 9/2011 Heroux ..... D6/601
D645,689 S * 9/2011 Heroux ..... D6/601
D645,690 S * 9/2011 Heroux ..... D6/601
D645,691 S * 9/2011 Heroux ..... D6/601
D645,692 S * 9/2011 Heroux ..... D6/601
D660,136 S * 5/2012 Jarowenko ..... D8/374
8,387,186 B2 * 3/2013 Yu ..... A47C 3/16 297/219.1
8,479,334 B1 * 7/2013 Leach ..... A47D 13/08 5/655.4
8,555,429 B2 * 10/2013 Leach ..... A01K 1/0353 4/572.1
D758,672 S * 6/2016 Hansen ..... D6/601
D759,403 S * 6/2016 Covelli ..... D6/601
D776,458 S * 1/2017 Verde Sanchez ..... D6/601
10,098,463 B1 * 10/2018 Cheng ..... A47C 7/021
10,543,394 B2 * 1/2020 Mandell ..... A63B 21/4039
D898,444 S * 10/2020 Chen ..... D6/601
2006/0252601 A1 * 11/2006 Baum ..... A47C 4/54 482/9
2007/0204406 A1 * 9/2007 Thisse ..... A47C 7/021 5/655.3
2011/0225735 A1 * 9/2011 Heroux ..... A47G 9/10 5/640
2013/0252791 A1 * 9/2013 Chang ..... A63B 23/03541 482/132
2016/0143463 A1 * 5/2016 Verde Sanchez ..... A47G 9/10 5/655
2017/0210611 A1 * 7/2017 Bingham ..... A44B 1/14

* cited by examiner

KNEE PILLOW AND METHOD OF USE

CROSS REFERENCE TO RELATED APPLICATION[S]

This application claims priority to U.S. Provisional Patent Application to Beth Rogers entitled "KNEE PILLOW," Ser. No. 62/792,992, filed Jan. 16, 2019, the disclosures of which are hereby incorporated entirely herein by reference.

BACKGROUND OF THE INVENTION

Technical Field

This invention relates generally to pillows and particularly to an improved pillow for placing between the knees while sleeping.

State of the Art

Sleeping with poor sleep posture can leave a person with pain, stiffness, and soreness. Lying on one's side without a pillow between the knees can negatively affect spine health, as well as overstretch or tighten muscles and ligaments and place unnecessary stress on the joints.

To prevent or alleviate pain, stiffness, and soreness, many people place a pillow between their legs, and, specifically, between their knees, while sleeping on their side in a fetal position. Lying on one's side in a fetal position with a pillow between the knees may help to keep the spine aligned in a neutral position.

However, many conventional pillows do not stay in place while the user is sleeping. Some are awkward to place into position because they must be oriented in a specific orientation for use. Some conventional pillows require use of uncomfortable straps for securing the pillow to a user's leg or legs. Other pillows are either too thick or too thin, thus negating the alignment purposes, or possibly allowing the knee joints to touch, creating additional pain or soreness.

Accordingly, what is needed is an improved pillow for placing between the knees while sleeping on one's side, that is easy to place into position, that stays in place while sleeping, and that ensures proper knee separation and alignment of the spine, hips, and pelvic area.

SUMMARY OF THE INVENTION

The present invention relates generally to pillows and particularly to an improved pillow for placing between the knees while sleeping.

A pillow for placing between the knees while sleeping is of substantially toroid shape. Embodiments of a pillow of the present invention comprise a substantially toroid-shaped outer casing with an inner volume containing a fill material.

In embodiments, the casing material and the fill are both fully machine-washable, as nearly as possible retaining their original shape and loft after washing.

The generally uniform round shape of the pillow provides for easy insertion of the pillow between the knees, by a user, because the pillow does not have to be oriented in any particular radial direction prior to insertion.

Both the top and bottom surfaces of embodiments of the pillow curve downward and inward toward the center, forming a top and bottom depression for cradling the knee joints. The top and bottom depressions provide a comfortable fit of the pillow between the knees while helping to prevent the pillow from unintentionally sliding out from between the knees.

In embodiments, the vertical, or nearly vertical, inner and outer edges of the pillow provide additional vertical support to help prevent the knees from touching. In some embodiments, a hole through the center of the pillow also provides an area where the knee joints may rest without contacting the pillow or each other.

In some embodiments, the outer seam may be sewn with a binding sewn thereto for covering exposed edges of the outer seam. In some embodiments, the binding may be a flange protruding outwardly therefrom. In other embodiments, the seam may be sewn with fringe, piping, or the like, coupled thereto. The binding, flange, piping, fringe, or other edge treatment of such embodiments may also act as an additional grasping point for easy grasping of the pillow by a user, further easing the insertion and/or removal of the pillow from between the knees. In some embodiments, the outer seam may be gathered and sewn with the edges facing inward, such gathering thereby providing additional vertical support for maintaining loft of the fill material and to help prevent the knees from touching.

A method of using a pillow for placing between the knees is also disclosed.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in conjunction with the Figures, wherein like reference numbers refer to similar items throughout the Figures, and:

DETAILED DESCRIPTION OF EMBODIMENTS OF THE INVENTION

As discussed above, embodiments of the present invention relate generally to pillows and particularly to an improved pillow for placing between the knees while sleeping.

Figure 2:
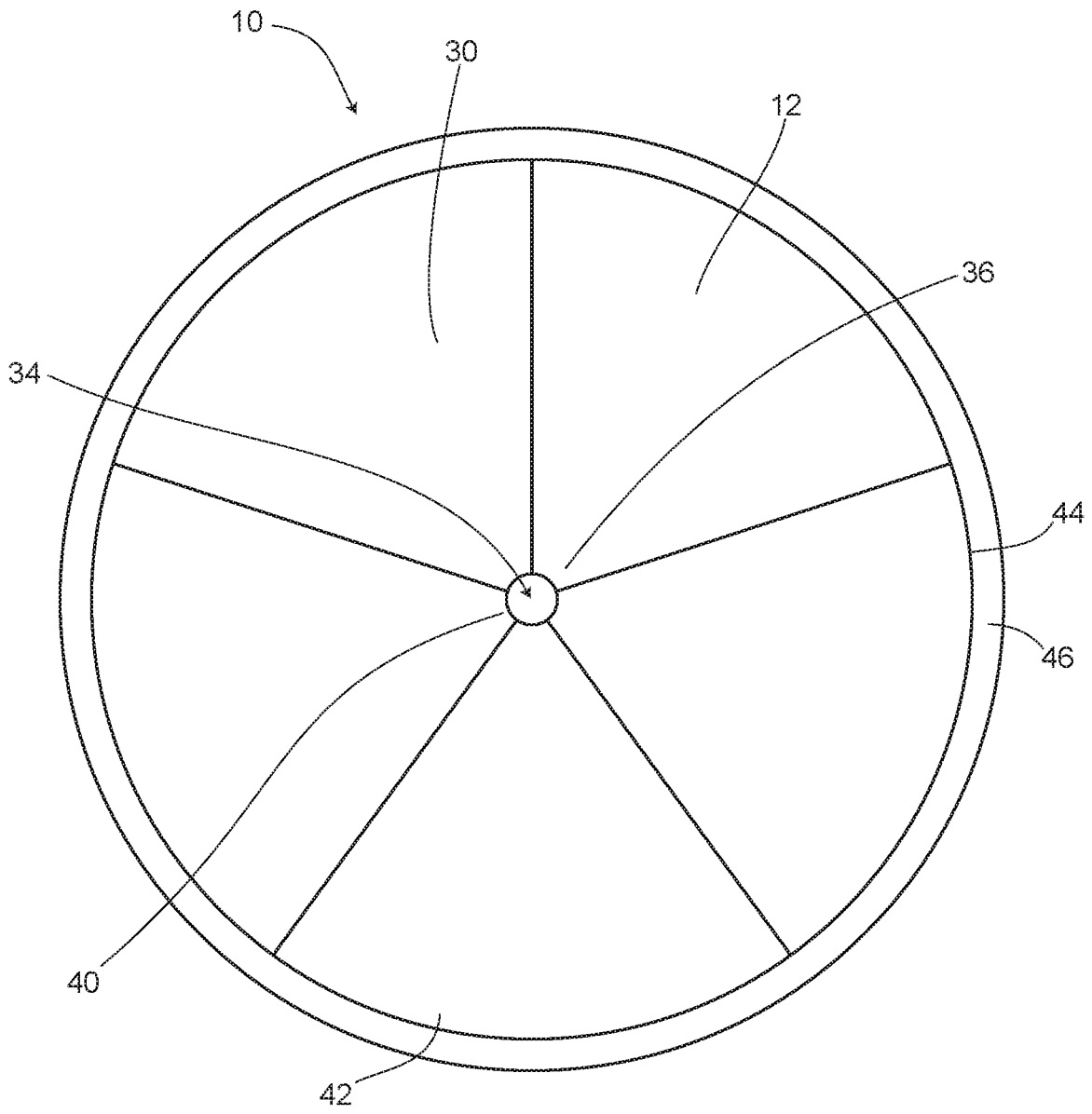
FIG. 2 is a top view of a knee pillow, in accordance with an embodiment.
Figure 3:
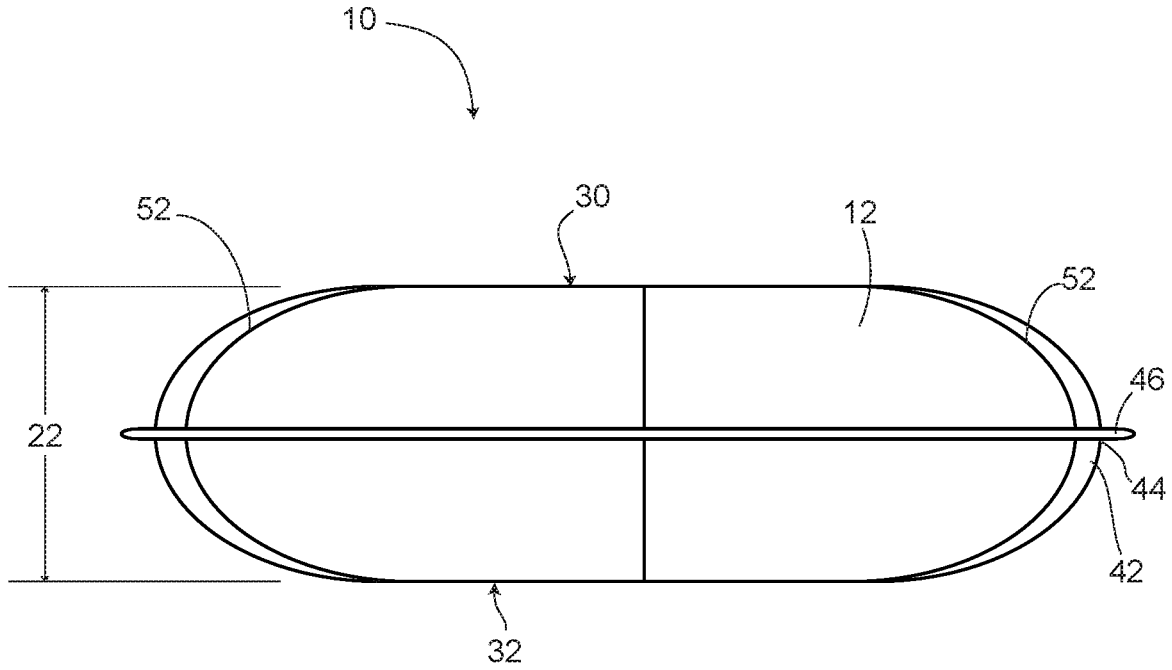
FIG. 3 is a side view of a knee pillow, in accordance with an embodiment.
Figure 4:
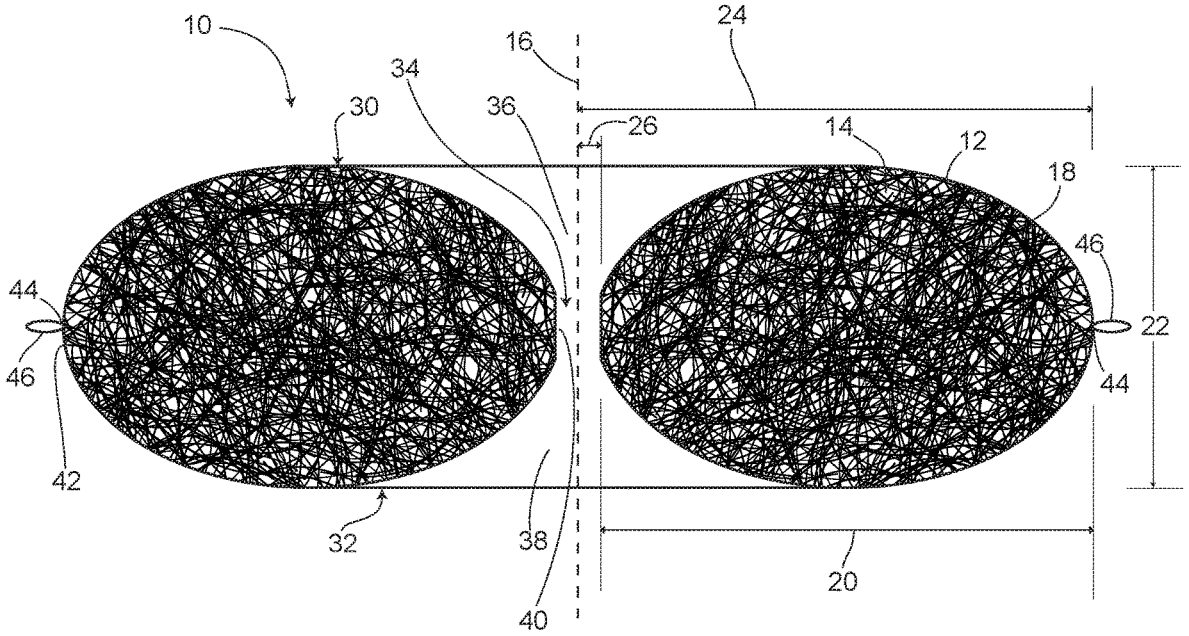
FIG. 4 is a section view of a knee pillow, in accordance with an embodiment.

Referring to the drawings, as shown in FIGS. 1-4, a pillow 10 for placing between the knees while sleeping is of substantially toroid shape. Embodiments of a pillow 10 of the present invention comprise a substantially toroid-shaped outer casing 12 with an inner volume containing a fill material 14. As shown in FIG. 4, the toroid shape is defined, substantially, by revolving an ellipse 18 in three-dimensional space about an axis 16 coplanar with the ellipse 18, the ellipse 18 having a width 20 that is greater than its height 22. As shown in FIG. 4, embodiments have an outer radius 24, an inner radius 26, and a thickness 22, wherein the thickness 22 is the height 22 of the ellipse. The outer radius 24 is defined as the distance from the axis 16 through the center opening 34 of the toroid-shaped pillow 10 to the outer edge 42 thereof. The inner radius 26 is defined as the radius of the center opening 34 as measured from the axis 16 through the center opening 34 to the inner edge 40 of the toroid-shaped pillow 10.

As shown in FIG. 4, in some embodiments, the thickness 22 may be from 2 inches to 5 inches, the minor radius 26 may be from ⅛ inch to ¾ inch, and the outer radius 24 may be from 3 inches to 8 inches. An embodiment has a thickness 22 of approximately 3 inches, an inner radius 26 of approximately 5/16 inch and an outer radius 24 of approximately 5¼ inches.

Referring to FIG. 4, the casing 12 may be made of any fabric material. Embodiments may comprise a casing 12 formed of fabric material that provides for easy insertion and is resistant to unintentional slipping out from between the knees, such as, without limitation, any short-nap or satin fabric. Either of a short-nap or satin fabric casing 12 makes insertion of the pillow 10 between the knees by a user very easy to accomplish, while also making the pillow 10 resistant to slipping out from between the knees unintentionally.

The fill material 14 may be any of a variety of materials used for stuffing pillows and other soft objects, known by persons of ordinary skill in the art, either now or in the future. For example, the fill material 14 may be a fluent solid material, such as multiple Styrofoam beads, natural or synthetic fibers, or the like, or it may be a viscoelastic polyurethane foam, low-resilience polyurethane foam (also known as memory foam), or a high-resilience polyurethane foam, or the like. The fill material 14 may be of a single unitary piece, or it may be of multiple torn, shredded, or cut pieces, or the like. In an embodiment, the fill material 14 may be a polyester fiberfill. In any case, embodiments comprise a fill material 14 that maintains a substantially uniform consistency throughout. It should be of sufficient density as to prevent the knees of a user from touching each other during normal use.

In embodiments, the casing 12 and the fill material 14 are both fully machine-washable, as nearly as possible retaining their original shape and loft after washing.

A substantially circular shape of the outer circumference of the pillow is preferred, as shown in FIG. 2. In contrast to some conventional knee pillows that must be oriented in a certain radial direction for placement between the knees, the generally uniform circular shape of the pillow 10 of the present invention provides for easy insertion of the pillow 10 between the knees, by a user, because the pillow 10 does not have to be oriented in any particular radial direction prior to insertion.

Referring to FIGS. 1-4, both the top and bottom surfaces, 30 and 32 respectively, of embodiments of the pillow 10 may curve downward and inward toward the center hole 34, forming top and bottom depressions, 36 and 38 respectively, for cradling the knee joints. The top and bottom depressions, 36 and 38, may provide a comfortable fit of the pillow 10 between the knees while helping to prevent the pillow 10 from unintentionally sliding out from between the knees.

In embodiments, the vertical, or nearly vertical, inner and outer edges, 40 and 42 respectively, of the pillow 10 provide additional vertical support to help prevent the knees from touching. The hole 34 through the center of the pillow 10 also provides an area where the knee joints may rest without contacting the pillow 10 or each other.

Figure 6:
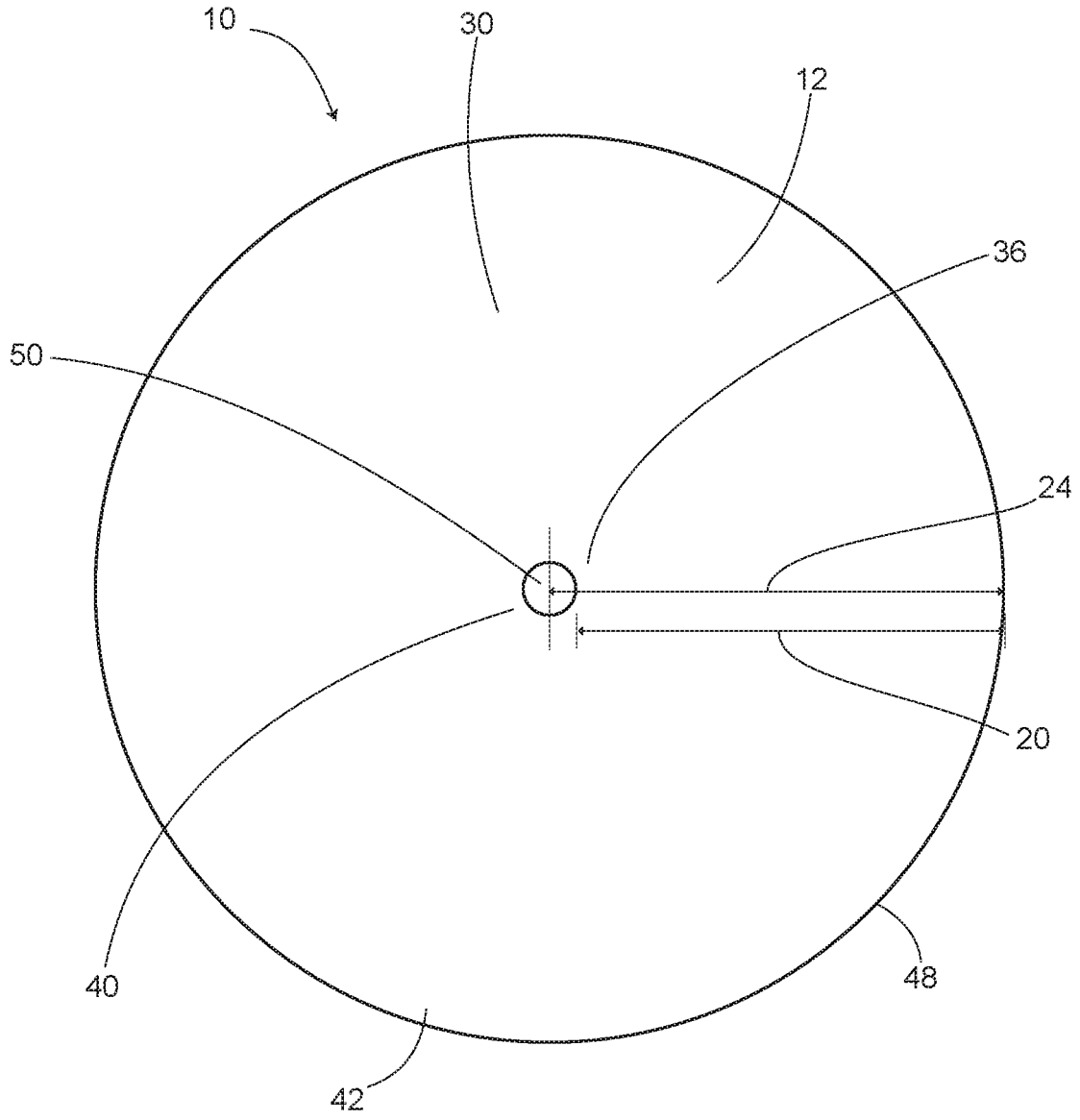
FIG. 6 is a top view of a knee pillow, in accordance with an alternative embodiment.

In some embodiments, as shown in FIG. 6, knee pillow 10 may have no hole 34 through the center but may otherwise comprise a tuft at the center 50, so as to provide both a top and bottom depression, 36 and 38, for cradling the knees. However, the center hole 34, as shown in FIGS. 1, 2, 4, and 7, is preferred because the vertical, or nearly vertical inner edge 40 formed thereabout provides additional vertical support, and the absence of material at the center hole provides for complete separation of the knee joints of a user, while in use.

Figure 1:
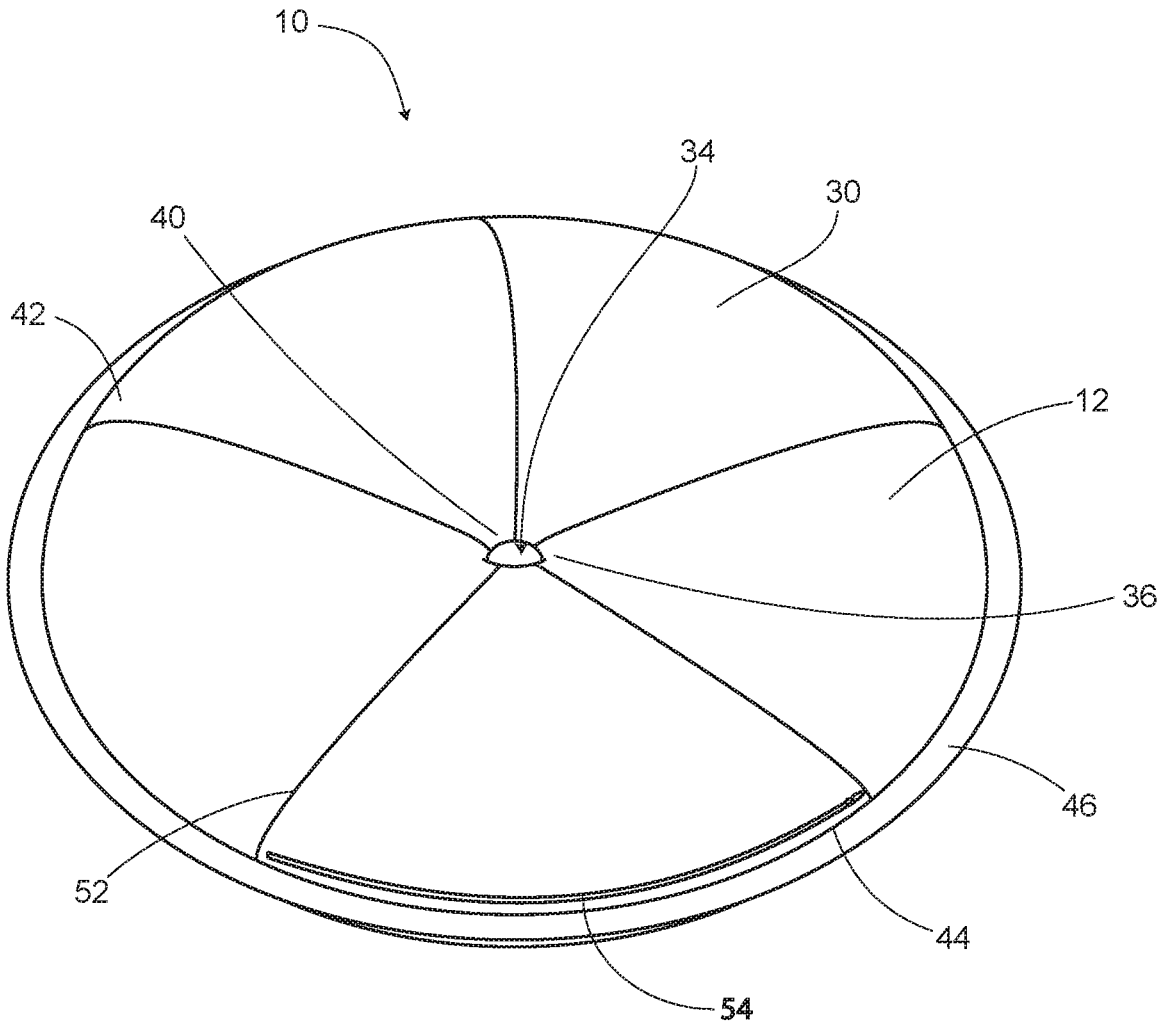
FIG. 1 is a perspective view of a knee pillow, in accordance with an embodiment.
Figure 5:
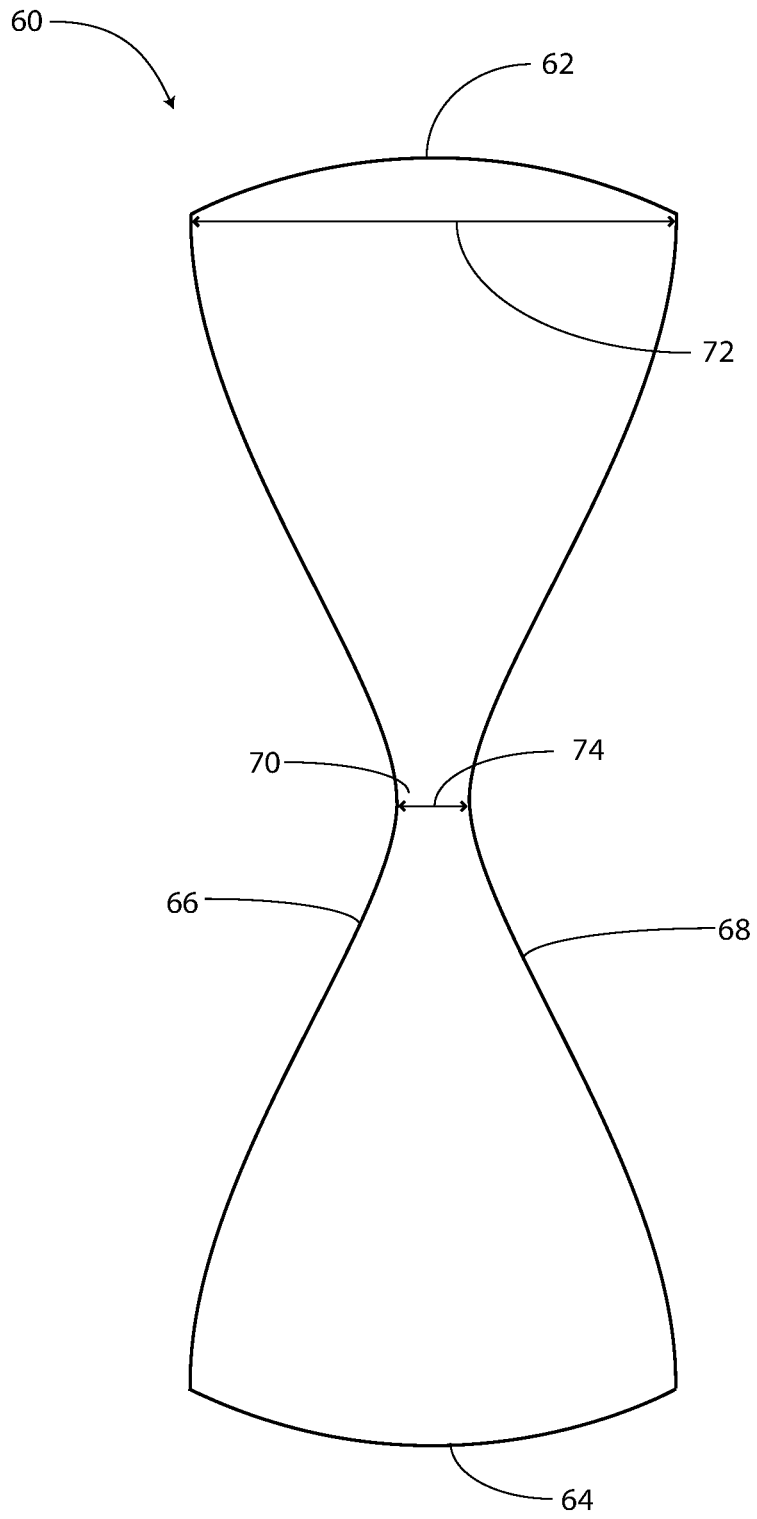
FIG. 5 illustrates an exemplary strip of fabric that may be used to form an outer casing of a knee pillow, in accordance with an embodiment.

As shown in FIGS. 1-3, the casing 12 may be formed of at least five hourglass-shaped strips of fabric 60, as shown in FIG. 5. Each strip 60 comprises opposed first and second side edges 66 and 68 and opposed first and second ends 62 and 64. Each strip 60 has a first width 72 at the ends 62 and 64 that is wider than a second width 74 at a location 70 midway between the first and second ends 62 and 64, thereof, so that each of the first and second side edges 66 and 68 is concave. In some embodiments, each of the first and second ends 62 and 64 may be convex. The strips 60 are sewn together at the side edges 66 and 68 thereof, wherein the first side edge 66 of each strip 60 is sewn to the second side edge 68 of each adjoining strip 60, respectively, forming a radial seam 52 as shown in FIGS. 1-3. Furthermore, each first end 62 of each strip 60 is sewn to the second end 64 thereof to form an outer seam 44, as shown in FIG. 1. With the seams 52 and 44 thus sewn, the casing 12 forms a toroid shape with a final outer seam 44 being disposed around the outer edge 42. An advantage of a pillow 10, thus sewn, is that the inner edge 40, around the center hole 34, does not have a circumferential seam, but only has radial seams 52, which configuration provides a measure of vertical support to help the pillow 10 maintain its loft.

As shown in FIGS. 1-4, in some embodiments, a binding 46 may be sewn to the outer seam 44 to cover the otherwise exposed edges of the outer seam 44. In some embodiments, the binding 46 may be a flange protruding outwardly therefrom, piping, fringe, or the like. The binding 46, flange, piping, fringe, or other similar edge treatments of such embodiments may also act as an additional grasping point for easy grasping of the pillow 10 by a user, further easing the insertion and/or removal of the pillow 10 from between the knees.

Figure 7:
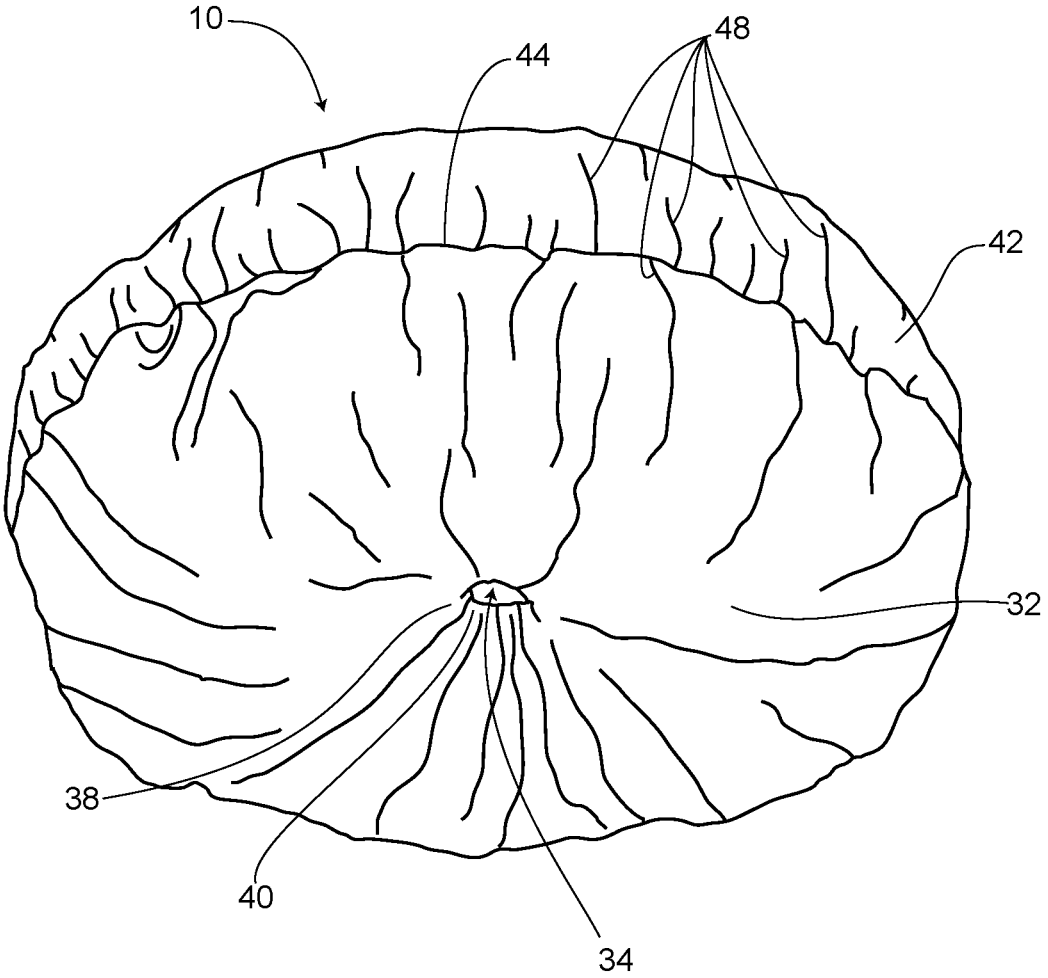
FIG. 7 is a perspective view of a knee pillow, in accordance with an alternative embodiment.

In some embodiments, as shown in FIGS. 6 and 7, the casing 12 is formed of two circular pieces of fabric sewn together along the outer edges thereof. In such embodiments, the inner radius 26 may be zero, so that there is no center hole 34, or the inner radius 26 may be greater than zero, so that there is a center hole 34. In such embodiments without a center hole 34, the two circular pieces of fabric may be stitched together at their centers, and the gathered inner edge 40 may form a tuft at the center 50 of the pillow 10. A knee pillow 10 with a tufted center 50 may still has a top depression 36 and a bottom depression 38, with a nearly vertical inner edge 40 for cradling the knees of a user while providing some vertical support. However, as discussed above, greater vertical support and enhancement of separation of the knees of a user is achieved with embodiments comprising a center hole 34.

In some embodiments, as shown in FIGS. 6 and 7, the outer edges are gathered so as to form a gathered inward-facing seam 48 along the outer edge 42 of knee pillow 10. In such embodiments with a gathered seam 48 along the outer edge 42, the gathered inward-facing seam 48 of such embodiments may provide additional vertical support along the outer edge 42 for preventing the knees of a user from touching and to prevent the pillow 10 from losing its loft and flattening out with use over time.

As shown in FIG. 1, in some embodiments, the pillow 10 may comprise an opening 54 for filling the pillow 10 with fill material 14. In some embodiments, opening 54 may be disposed along a first edge of at least one of the strips 60 at the outer edge 42. In some embodiments, a radial seam 52 may comprise an opening 54 for filling the pillow 10 with fill material 14. The opening 54 may be sewn together or otherwise closed after filling is complete. For example, the opening 54 may be closed with a zipper, with hook and loop fasteners, or any other means of securing an opening 54 known by a person of ordinary skill in the art. In some embodiments, the outer seam 44, and/or a radial seam 52, may incorporate a tag (not shown) sewn therein for labeling purposes.

Figure 8:
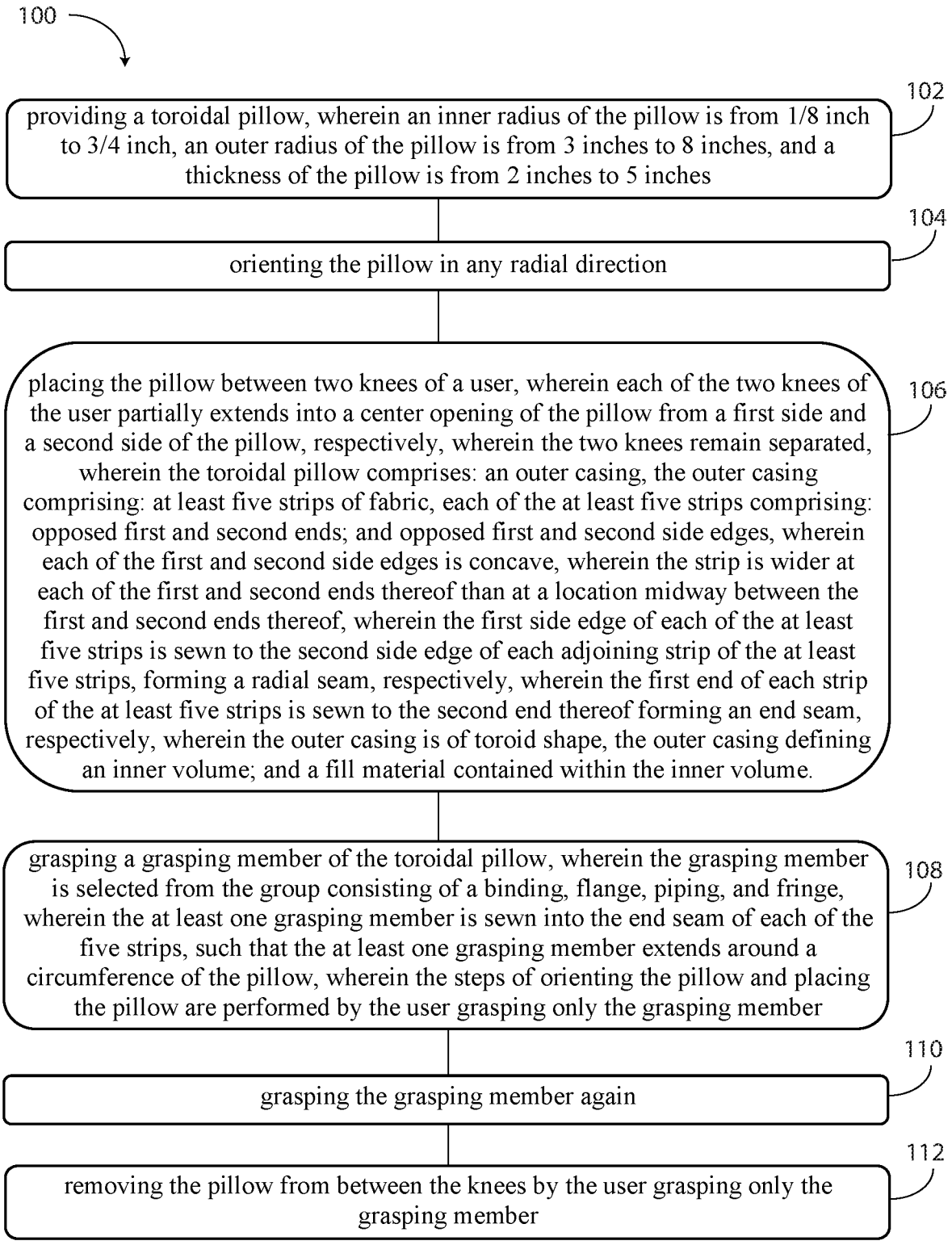
FIG. 8 is a flow diagram of steps of a method of using a knee pillow, in accordance with an embodiment.

Referring to the drawings, FIG. 8 illustrates a flow diagram of a method 100 of using a pillow, comprising: providing a toroidal pillow, wherein an inner radius of the pillow is from ⅛ inch to ¾ inch, an outer radius of the pillow is from 3 inches to 8 inches, and a thickness of the pillow is from 2 inches to 5 inches [Step 102]; orienting the pillow in any radial direction [Step 104]; placing the pillow between two knees of a user, wherein each of the two knees of the user partially extends into a center opening of the pillow from a first side and a second side of the pillow, respectively, wherein the two knees remain separated, wherein the toroidal pillow comprises: an outer casing, the outer casing comprising: at least five strips of fabric, each of the at least five strips comprising: opposed first and second ends; and opposed first and second side edges, wherein each of the first and second side edges is concave, wherein the strip is wider at each of the first and second ends thereof than at a location midway between the first and second ends thereof, wherein the first side edge of each of the at least five strips is sewn to the second side edge of each adjoining strip of the at least five strips, forming a radial seam, respectively, wherein the first end of each strip of the at least five strips is sewn to the second end thereof forming an end seam, respectively, wherein the outer casing is of toroid shape, the outer casing defining an inner volume; and a fill material contained within the inner volume [Step 106]. The method 100 may further comprise: grasping a grasping member of the toroidal pillow, wherein the grasping member is selected from the group consisting of a binding, flange, piping, and fringe, wherein the at least one grasping member is sewn into the end seam of each of the five strips, such that the at least one grasping member extends around a circumference of the pillow, wherein the steps of orienting the pillow and placing the pillow are performed by the user grasping only the grasping member [Step 110]. The method 100 may yet further comprise: grasping the grasping member again [Step 110]; and removing the pillow from between the knees by the user grasping only the grasping member [Step 112].

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A pillow, comprising:

an outer casing, the outer casing comprising:

at least five strips of fabric, each of the at least five strips comprising:

opposed first and second ends; and opposed first and second side edges, wherein each of the first and second side edges is concave, wherein the strip is wider at each of the first and second ends thereof than at a location midway between the first and second ends thereof, wherein the first side edge of each of the at least five strips is sewn to the second side edge of each adjoining strip of the at least five strips, forming a radial seam, respectively, wherein the first end of each strip of the at least five strips is sewn to the second end thereof forming an end seam, respectively, wherein the outer casing is of toroid shape, the outer casing defining an inner volume; and a fill material contained within the inner volume.

2. The pillow of claim 1, further comprising:

at least one grasping member selected from the group consisting of a binding, flange, piping, and fringe, wherein the at least one grasping member is sewn into the end seam of each of the five strips, such that the at least one grasping member extends around a circumference of the pillow.

3. The pillow of claim 2, wherein each of the first and second ends of each of the at least five strips is convex.

4. The pillow of claim 3, further comprising:

a zippered opening disposed along a first edge of at least one of the five strips.

5. The pillow of claim 1, wherein an inner radius thereof is from ⅛ inch to ¾ inch.

6. The pillow of claim 5, wherein an outer radius thereof is from 3 inches to 8 inches.

7. The pillow of claim 6, wherein a thickness thereof is from 2 inches to 5 inches.

8. The pillow of claim 7, further comprising:

a zippered opening disposed along a first edge of at least one of the five strips.

9. The pillow of claim 8, further comprising:

at least one grasping member selected from the group consisting of a binding, flange, piping, and fringe, wherein the at least one grasping member is sewn into the end seam of each of the five strips, such that the at least one grasping member extends around a circumference of the pillow.

10. The pillow of claim 9, wherein each of the first and second ends of each of the at least five strips is convex.

11. The pillow of claim 10, further comprising:

a zippered opening disposed along a first edge of at least one of the five strips.

* * * * *